US010001307B2

(12) United States Patent
Kim et al.

(10) Patent No.: US 10,001,307 B2
(45) Date of Patent: Jun. 19, 2018

(54) REFRIGERATOR AND METHOD FOR CONTROLLING THE SAME

(71) Applicant: Samsung Electronics Co., Ltd., Suwon-si (KR)

(72) Inventors: Yong Han Kim, Hwaseong-si (KR); Jong-Eon Si, Gwangju (KR); Su-Cheol Yoo, Hwaseong-si (KR); Ha-Jin Jeong, Gwangju (KR); Jae Hee Baek, Changwon-si (KR); Chang Wan Han, Busan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 234 days.

(21) Appl. No.: 14/735,296

(22) Filed: Jun. 10, 2015

(65) Prior Publication Data

US 2016/0018146 A1 Jan. 21, 2016

(30) Foreign Application Priority Data

Jul. 16, 2014 (KR) ..... 10-2014-0089648

(51) Int. Cl.
*F25B 49/00* (2006.01)
*F25D 11/02* (2006.01)

(52) U.S. Cl.
CPC ..... *F25B 49/00* (2013.01); *F25D 11/022* (2013.01); *F25D 2700/123* (2013.01)

(58) Field of Classification Search
CPC ... F25B 49/00; F25D 11/022; F25D 2700/123
See application file for complete search history.

(56) References Cited

U.S. PATENT DOCUMENTS

2005/0115259 A1* 6/2005 Ergarac ..... F25D 29/00 62/228.1
2006/0260333 A1 11/2006 Wetekamp et al.
(Continued)

OTHER PUBLICATIONS

Partial European Search Report dated Nov. 27, 2015 in European Patent Application No. 15167737.4.
(Continued)

*Primary Examiner* — Emmanuel Duke
(74) *Attorney, Agent, or Firm* — Staas & Halsey LLP

(57) ABSTRACT

A refrigerator includes a refrigerating compartment temperature sensor, a cooling apparatus, in a state when driving time points of a refrigerating compartment and a freezing compartment are synchronized, to maintain an inside temperature of the refrigerating compartment by performing a cooling operation of the refrigerating compartment on the basis of a cut-off temperature of the refrigerating compartment that is varied by a difference between a temperature of the refrigerating compartment at a driving time point of the refrigerating compartment that is sensed by the refrigerating compartment temperature sensor and a cut-in temperature of the refrigerating compartment, and a control unit to control the driving of the cooling apparatus by varying the cut-off temperature of the cooling apparatus according to the difference between the temperature of the refrigerating compartment at the driving time point of the refrigerating compartment and the cut-in temperature of the refrigerating compartment.

14 Claims, 9 Drawing Sheets

(56) References Cited

U.S. PATENT DOCUMENTS

| | | | | |
|---|---|---|---|---|
| 2006/0266059 | A1* | 11/2006 | Wetekamp | F25C 5/005 62/187 |
| 2007/0157645 | A1* | 7/2007 | Anell | F25D 17/065 62/187 |
| 2008/0221740 | A1* | 9/2008 | Boer | F25D 29/00 700/300 |
| 2009/0113923 | A1* | 5/2009 | Young | F25D 17/065 62/441 |
| 2014/0021838 | A1 | 1/2014 | Jung et al. | |

OTHER PUBLICATIONS

European Communication dated Oct. 11, 2017 in European Patent Application No. 15167737.4.

* cited by examiner

REFRIGERATOR AND METHOD FOR CONTROLLING THE SAME

CROSS-REFERENCE TO RELATED APPLICATIONS

This application claims the priority benefit of the Korean Patent Application No. 10-2014-0089648, filed on Jul. 16, 2014, in the Korean Intellectual Property Office, the disclosure of which is incorporated herein by reference.

BACKGROUND

1. Field

The following description relates to a refrigerator and a method for controlling the same.

2. Description of the Related Art

A technology configured to transmit/receive variety of information as a household appliance is connected to a network is recently being provided so that a user convenience is increased.

For example, in a case of a refrigerator, the refrigerator is generally divided into a refrigerating compartment and a freezing compartment, and the refrigerating compartment is provided to maintain the temperature thereof in the range of between approximately 3° C. and approximately 4° C. so that various foods such as vegetables and fruits may be stored for a long period of time in a fresh state, and the freezing compartment is provided to maintain the temperature thereof below approximately 0° C. so that various foods, including meat products, may be stored in a frozen state.

Recently, to increase the convenience of a user using the refrigerator, a door dispenser is installed and provided at a door so that water or ice may be easily supplied without having to open the door of the refrigerator.

In addition, other than the fundamental functions described above, the refrigerator, by use of the network, is provided to provide a variety of convenient functions such as outputting news information, such as weather information, though a display unit, or providing information on the foods stored at the refrigerator, and for the above, various applications are installed on the refrigerator.

Meanwhile, as illustrated in FIG. 8, the driving pattern of the refrigerating compartment and the freezing compartment may include a pattern 1 provided such that a cooling cycle is simultaneously driven at the refrigerating compartment and the freezing compartment, and then the cooling cycle is independently driven at the freezing compartment; a pattern 2 provided such that the cooling cycle is simultaneously driven at the refrigerating compartment and the freezing compartment, and then the cooling cycle is independently driven at the freezing compartment, and next, the cooling cycle is simultaneously driven at the refrigerating compartment and the freezing compartment, and lastly, the cooling cycle is independently driven at the freezing compartment; and a pattern 3 provided such that the cooling cycle is independently driven at the each of the refrigerating compartment and the freezing compartment.

However, with respect to the pattern 2, a loss of cycle may occur due to the rapid change in the condition of the cooling cycle as the result of an occurrence of a re-cooling of the refrigerating compartment during the cooling cycle, and with respect to the pattern 3, an ON/OFF loss may be increased as the result of an independent driving of the cooling cycle at the refrigerating compartment and an occurrence of an independent driving of the cooling cycle at the freezing compartment while a compressor is OFF.

For the above, a method of increasing energy efficiency as the pattern of the cycles of the refrigerating compartment and the freezing compartment are stably maintained as in the pattern 1 may be desired.

That is, in a case of independently driving the cooling cycle of the freezing compartment, a prevention of an entry of the refrigerating compartment into the cooling cycle, and a restraint of an occurrence of the independent driving of the cooling cycle of the refrigerating compartment at the time of when the compressor is OFF are to occur. For the above, when the temperature of an inside of the freezing compartment is reached at a cut-in temperature, the cooling cycle is initiated. However, with respect to the refrigerating compartment, in a case when the temperature of an inside of the refrigerating compartment is further increased as high as a predetermined temperature, the cooling cycle is initiated so that the driving of the compressor by use of the refrigerating compartment is minimized.

The controlling of the temperature of the refrigerating compartment may be equal as in FIG. 9, and when the inside temperature of the refrigerating compartment reaches a cut-off temperature of the refrigerating compartment regardless of the starting point of the cooling cycle of the refrigerating compartment, the cooling cycle is finished. The controlling of the temperature of the refrigerating compartment as such, the occurrence of the independent driving of the cooling cycle of the refrigerating compartment, at the time of when the prevention of the entry of the freezing compartment into the cooling cycle and when the compressor is OFF, may be prevented. However, as illustrated, a difficulty of not being able to stably maintain the average temperature of the refrigerating compartment may occur, and the difficulty as such may affect the reliability of the refrigerator, which is configured to store foods in a fresh state.

SUMMARY

Additional aspects of the disclosure will be set forth in part in the description which follows and, in part, will be obvious from the description, or may be learned by practice of the disclosure.

In accordance with an aspect of the present disclosure, a refrigerator includes a refrigerating compartment, a freezing compartment, a refrigerating compartment temperature sensor, a cooling apparatus, and a control unit. The refrigerating compartment temperature sensor may sense a temperature of the refrigerating compartment. The cooling apparatus, in a state when driving time points of the refrigerating compartment and the freezing compartment are synchronized, may maintain an inside temperature of the refrigerating compartment by performing a cooling operation of the refrigerating compartment on the basis of a cut-off temperature of the refrigerating compartment that is varied by a difference between a temperature of the refrigerating compartment at a driving time point of the refrigerating compartment that is sensed by the refrigerating compartment temperature sensor and a cut-in temperature of the refrigerating compartment. The control unit may control the driving of the cooling apparatus by varying the cut-off temperature of the cooling apparatus according to the difference between the temperature of the refrigerating compartment at the driving time point of the refrigerating compartment and the cut-in temperature of the refrigerating compartment.

The cooling apparatus may include a compressor to compress refrigerant at high pressure, a condenser to release heat of the compressed refrigerant, an expansion valve for the refrigerating compartment to decompress the refrigerant having released heat, and an evaporator for the refrigerating compartment to absorb heat by use of the refrigerant and deliver the refrigerant having absorbed the heat to the compressor.

The cooling apparatus may further include a flow path converting valve to selectively deliver a refrigerant condensed at the condenser to the expansion valve for the refrigerating compartment such that the refrigerant delivered to the expansion valve for the refrigerating compartment is blocked in a case when the inside temperature of the refrigerating compartment reaches the cut-off temperature of the refrigerating compartment.

The refrigerator may further include a refrigerating compartment blower fan to blow the heat-exchanged air at the evaporator for the refrigerating compartment to the refrigerating compartment.

The control unit may include a temperature sensing unit to sense an inside temperature of the refrigerating compartment through the refrigerating compartment temperature sensor, a driving unit to control the driving of the cooling apparatus according to the temperature of the refrigerating compartment at the driving time point and the cut-off temperature of the refrigerating compartment, and a temperature setting unit to variably set the cut-off temperature of the refrigerating compartment as to stably maintain the temperature of the refrigerating compartment according to the difference between the temperature of the refrigerating compartment at the driving time point of the refrigerating compartment and the cut-in temperature of the refrigerating compartment.

The temperature setting unit may variably set the cut-off temperature of the refrigerating compartment as much as the difference between the temperature of the refrigerating compartment at the driving time point of the refrigerating compartment and the cut-in temperature of the refrigerating compartment.

The temperature setting unit may variably adjust the cut-off temperature of the refrigerating compartment so that a temperature increase of the refrigerating compartment at the driving time point of the refrigerating compartment and a temperature decrease of the cut-off temperature of the refrigerating compartment are equal to each other while having an average temperature of the refrigerating compartment as a reference.

The temperature setting unit may maintain the cut-off temperature of the refrigerating compartment in a set state, in a case when the temperature of the refrigerating compartment at the driving time point is equal to the cut-in temperature of the refrigerating compartment.

In accordance with an aspect of the present disclosure, a controlling method of a refrigerator may include driving, by the refrigerator, a cooling apparatus of a refrigerating compartment and a freezing compartment, sensing a temperature of the refrigerating compartment at a driving time point of the refrigerating compartment, determining if the temperature at the driving time point of the refrigerating compartment is equal to a cut-in temperature of the refrigerating compartment, variably adjusting a cut-off temperature of the refrigerating compartment according to a difference between a temperature of the refrigerating compartment at a driving time point of the refrigerating compartment and a cut-in temperature of the refrigerating compartment, in a case when the temperature of the refrigerating compartment at the driving time point of the refrigerating compartment is not equal to the cut-in temperature of the refrigerating compartment, and finishing a driving of the cooling apparatus of the refrigerating compartment, in a case when an inside temperature of the refrigerating compartment is reached at the cut-off temperature of the refrigerating compartment.

In the variably adjusting of the cut-off temperature of the refrigerating compartment according to the difference between the temperature of the refrigerating compartment at the driving time point and the cut-in temperature of the refrigerating compartment, the cut-off temperature may be variably set as much as the difference between the temperature of the refrigerating compartment at the driving time point of the refrigerating compartment and the cut-in temperature of the refrigerating compartment.

The cut-off temperature of the refrigerating compartment may be variably adjusted so that a temperature increase of the refrigerating compartment at the driving time point and a temperature decrease of the cut-off temperature of the refrigerating compartment are equal to each other while having an average temperature of the refrigerating compartment as a reference.

In a case when the temperature of the refrigerating compartment at the driving time point of the refrigerating compartment is equal to the cut-in temperature of the refrigerating compartment, the cut-off temperature of the refrigerating compartment may be maintained at a set state.

As the present disclosure is provided to variably set a cut-off temperature of a refrigerating compartment according to the difference between the temperature of the refrigerating compartment at the time of when a cooling is started and a cut-in temperature of the refrigerating compartment, the temperature of the refrigerating compartment may be stably maintained at all times regardless of the driving state of the refrigerating compartment, and as a result, the freshness of various foods stored at the refrigerating compartment may be improved.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
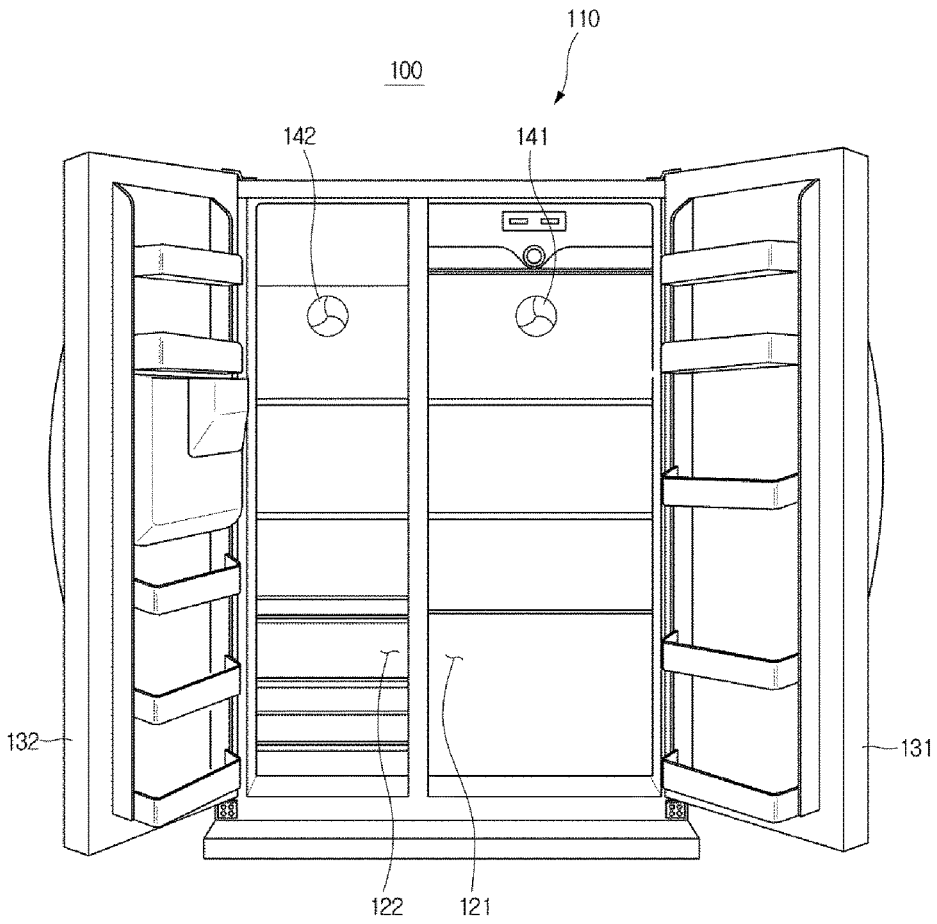
FIG. 1 is a front view illustrating a refrigerator.

The purposes, advantages and characteristics of the present disclosure will be clarified by referring to the desired embodiments and detailed descriptions that are hereinafter related to the attached drawings. With respect to adding reference numbers to the components of each drawing in the present disclosure, regarding the identical components, even in a case when the identical components as such are illustrated on a different drawing, the identical components as such will be provided with the same reference number. In addition, with respect to describing the disclosure, in a case when the detailed descriptions with respect to the related art are determined to unnecessarily obscure the principles of the present disclosure, the detailed descriptions as such will be omitted. In the present disclosure, the terminology such as "a first," "a second," "the first," or "the second" is used as to distinguish one component from a different component, while each component is not limited to the terminology as such.

Reference will now be made in detail to the embodiments of the present disclosure, examples of which are illustrated in the accompanying drawings, wherein like reference numerals refer to like elements throughout.

Figure 2:
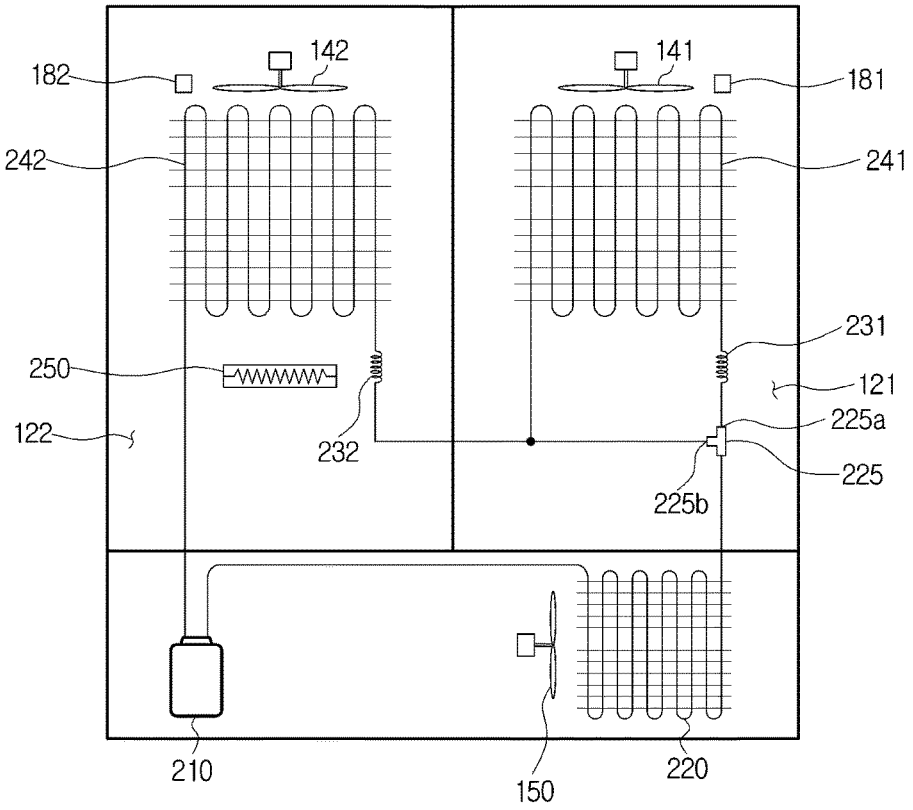
FIG. 2 is a drawing illustrating a cooling apparatus of the refrigerator.

FIG. 1 is a front view illustrating a refrigerator, and FIG. 2 is a drawing illustrating a cooling apparatus of the refrigerator.

Referring to FIG. 1 and FIG. 2, a refrigerator 100 may include a body 110 forming an exterior appearance of the refrigerator 100, a refrigerating compartment 121 to store material to be stored in a refrigerated state, a freezing compartment 122 to store material to be stored in a frozen state, and a cooling apparatus 200 to cool the refrigerating compartment 121 and the freezing compartment 122.

As illustrated in FIG. 1, the body 110 is provided with a duct (not shown) through which the air cooled by use of the cooling apparatus 200 flows at an inside space thereof, and a machinery compartment (not shown) at which a portion of the cooling apparatus 200 is installed is provided at a lower portion of the body 110.

The refrigerating compartment 121 and the freezing compartment 122 configured to store material to be stored are disposed in the body 110.

The refrigerating compartment 121 and the freezing compartment 122 are divided into left and right sides while having a middle partition between, and front surfaces of the refrigerating compartment 121 and the freezing compartment 122 are provided to be open.

In addition, the refrigerating compartment 121 and the freezing compartment 122 are provided with a refrigerating compartment temperature sensor 181 and a freezing compartment temperature sensor 182, respectively. In detail, the temperature sensed by use of the refrigerating compartment temperature sensor 181 and the freezing compartment temperature sensor 182 is delivered to a control unit, or controller, which is to be described later. The refrigerating compartment temperature sensor 181 and the freezing compartment temperature sensor 182 may employ a thermistor provided such that an electrical load is changed according to temperature.

Doors 131 and 132 may be formed at the refrigerating compartment 121 and the freezing compartment 122, respectively, to shield the refrigerating compartment 121 and the freezing compartment 122 provided with front surfaces thereof open from outside air. The doors 131 and 132 may be provided with a display unit, or display, and an input unit formed thereto, respectively, as the display unit is configured to output information related to the refrigerator 100 and the input unit is provided to receive motion commands from a user.

As illustrated in FIG. 2, the cooling apparatus 200 may include a compressor 210, a condenser 220, a flow path converting valve 225, a refrigerating compartment expansion valve 231, a freezing compartment expansion valve 232, a refrigerating compartment evaporator 241, and a freezing compartment evaporator 242.

The compressor 210, by use of the rotational force of a motor installed at the machinery compartment (not shown) provided at a lower portion of the body 110 and configured to be rotated while supplied with electrical energy from a outside power source, is configured to compress low-pressure, vapor-state refrigerant, which is evaporated by use of the refrigerating compartment evaporator 241 and the freezing compartment evaporator 242, at high pressure, and transfer the refrigerant to the condenser 220.

The motor (not shown) of the compressor 210 is configured to rotate about a rotational axis through a magnetic reciprocal action between a rotator and a stator while provided with a driving current from the driving unit, which is to be described later. The rotational force generated by use of the motor (not shown) is converted into a force of linear motion by use of a piston (not shown) of the compressor 210, and through the force of linear motion of the piston (not shown), the vapor-state refrigerant may be compressed at high pressure. Alternatively, the rotational force generated by use of the motor (not shown) of the compressor 210 may be delivered to rotational wings connected to the rotational axis of the motor, the by use of the stick-slip phenomenon between a container (not shown) of the compressor 210 and the rotational wings, the vapor-state refrigerant may be compressed at high pressure.

The motor of the compressor 210 may employ an inductive AC servo motor, a synchronous AC servo motor, or a BLDC (BrushLess Direct Current) motor, for example.

The refrigerant may be circulated at the condenser 220, the refrigerating compartment expansion valve 231, the freezing compartment expansion valve 232, the refrigerating compartment evaporator 241, and the freezing compartment evaporator 242 by use of the pressure of the compressor 210. That is, the compressor 210 is provided to perform the most significant role of the cooling apparatus 200, that is, the cooling of the refrigerating compartment 121 and the freezing compartment 122, and the driving of the cooling apparatus 200 may be referred to the driving of the compressor 210.

The condenser 220 may be installed at the machinery compartment (not shown) of the lower portion of the body 110 or may be installed at a rear surface of the refrigerator 100.

The vapor-state refrigerant compressed by use of the compressor 210 is condensed while passing through the condenser 220, and the state thereof is changed from vapor to liquid. The refrigerant is provided to release latent heat to the condenser 220 during a process of being condensed. The latent heat of a refrigerant refers to the heat energy being released to outside air as a vapor-state refrigerant which is cooled to a boiling point is state-changed into a liquid-state refrigerant having the same temperature. In addition, the heat energy being absorbed from outside air by a refrigerant refers to the latent heat as a liquid-state refrigerant which is heated to a boiling point is state-changed into a vapor-state refrigerant having the same temperature.

By the latent heat being released from the refrigerant, the condenser 220 is provided with an increased temperature thereof, and thus in a case when the condenser 220 is installed in the machinery compartment (not shown), a separate radiating fan 150 configured to cool the condenser 220 is provided.

The liquid-state refrigerant condensed by use of the condenser 220 may be selectively delivered by use of the flow path converting valve 225. The flow path converting valve 225 may be provided with a three-way valve having one entry unit and two exit units employed thereto, and the one of the two exit units configured to outlet a refrigerant toward a side of the refrigerating compartment evaporator 241 refers to as a refrigerating compartment refrigerant outlet unit 225*a* and the other one of the two exit units configured to outlet a refrigerant toward a side of the freezing compartment evaporator 242 refers to as a freezing compartment refrigerant outlet unit 225*b*.

The flow path converting valve 225 is provided to open the refrigerating compartment refrigerant outlet unit 225*a* so that the refrigerant may pass through both the refrigerating compartment evaporator 241 configured to cool the refrigerating compartment 121 and the freezing compartment evaporator 242 configured to cool the freezing compartment 122, and by opening the freezing compartment refrigerant outlet unit 225*b*, the refrigerant is provided to pass through only the freezing compartment evaporator 242. In other words, in a case of cooling the refrigerating compartment 121, the flow path converting valve 225 is configured to open the refrigerating compartment refrigerant outlet unit 225*a* so that the refrigerant may pass through the both of the refrigerating compartment evaporator 241 and the freezing compartment evaporator 242, and in a case when cooling the freezing compartment 122, the flow path converting valve 225 is configured to open the freezing compartment refrigerant outlet unit 225*b* so that the refrigerant may pass through only the freezing compartment evaporator 242. That is, whether the flow path converting valve 225 is provided to open the refrigerating compartment refrigerant outlet unit 225*a* or the freezing compartment refrigerant outlet unit 225*b*, the refrigerant is provided to pass through the freezing compartment evaporator 242 at all times, and thus the freezing compartment 122 is cooled when the compressor 210 is driven.

The refrigerant provided with a selected flow path by use of the flow path converting valve 225 is provided with the pressure thereof lowered by use of the refrigerating compartment expansion valve 231 and the freezing compartment expansion valve 232. That is, the refrigerating compartment expansion valve 231 and the freezing compartment expansion valve 232 are decompressed to the level of pressure at which evaporation may take place by throttling high-pressure, liquid-state refrigerant. Throttling refers to a reduction of pressure without exchanging heat with outside air when a fluid passes through a narrow flow path, such as a nozzle or orifice, for example.

In addition, the refrigerating compartment expansion valve 231 and the freezing compartment expansion valve 232 may be able to adjust the amount of the refrigerant being provided at the refrigerating compartment evaporator 241 and the freezing compartment evaporator 242, respectively, so that sufficient heat may be absorbed at the refrigerating compartment evaporator 241 and the freezing compartment evaporator 242. In addition, the opening/closing as well as the degree of opening of the refrigerating compartment expansion valve 231 and the freezing compartment expansion valve 232 are adjusted by use of a control unit, which is to be described later.

The refrigerating compartment evaporator 241 and the freezing compartment evaporator 242 are provided at the duct (not shown) provided at an inside space of the body 110 as described above, and configured to evaporate the low-pressure, liquid-state refrigerant, which is compressed by use of the refrigerating compartment expansion valve 231 and the freezing compartment expansion valve 232. The liquid-state refrigerant is provided to absorb latent heat from the refrigerating compartment evaporator 241 and the freezing compartment evaporator 242 while in the process of evaporation.

The refrigerating compartment evaporator 241 and the freezing compartment evaporator 242 are cooled as the heat energy thereof is taken away by the refrigerant, and the air around the refrigerating compartment evaporator 241 and the freezing compartment evaporator 242 are cooled by use of the refrigerating compartment evaporator 241 and the freezing compartment evaporator 242, both of which are cooled.

The low-pressure, vapor-state refrigerant that is evaporated by use of refrigerating compartment evaporator 241 and the freezing compartment evaporator 242 is provided again at the compressor 210, which is described above, and the cooling cycle is repeated.

In the cooling process of the refrigerating compartment evaporator 241 and the freezing compartment evaporator 242, the vapor around the refrigerating compartment evaporator 241 and the freezing compartment evaporator 242 is sublimed, and frost may form at the refrigerating compartment evaporator 241 and the freezing compartment evaporator 242, or as the vapor around the refrigerating compartment evaporator 241 and the freezing compartment evaporator 242 adheres to the surfaces of the refrigerating compartment evaporator 241 and the freezing compartment evaporator 242 and then frozen, and frost may form at the refrigerating compartment evaporator 241 and the freezing compartment evaporator 242.

The refrigerator 100 is provided to remove the frost formed at the refrigerating compartment evaporator 241, which is configured to cool the refrigerating compartment 121, by use of a blower fan 141, which is to be described later, and a defrost heater 250 is provided to remove the frost formed at the freezing compartment evaporator 242, which is configured to cool the freezing compartment 122. The refrigerating compartment 121, by supplying the air of the refrigerating compartment 121 toward the refrigerating compartment evaporator 241 by use of the blower fan while the temperature thereof is generally maintained above 0° C., may be able to remove the frost formed at the refrigerating compartment evaporator 241.

The defrost heater 250 is provided at a lower surface of the freezing compartment evaporator 242, and is configured to generate heat through an electrical load.

The refrigerating compartment temperature sensor 181 and the freezing compartment temperature sensor 182 configured to sense the temperatures of the refrigerating compartment evaporator 241 and the freezing compartment evaporator 242, respectively, are provided at upper sides of the refrigerating compartment evaporator 241 and the freezing compartment evaporator 242.

The refrigerating compartment temperature sensor 181 and the freezing compartment temperature sensor 182 include a refrigerating compartment temperature sensor 181 configured to sense the temperature of the refrigerating compartment evaporator 241 and a freezing compartment temperature sensor 182 configured to sense the temperature of the freezing compartment evaporator 242, and the refrigerating compartment temperature sensor 181 and the freezing compartment temperature sensor 182 are configured to provide the results of detection to the control unit, which is to be described later.

The refrigerating compartment blower fan 141 and a freezing compartment blower fan 142 are configured to circulate air between the duct (not shown) inside the body 110 and the refrigerating compartment 121 and the freezing compartment 122. That is, the refrigerating compartment blower fan 141 and the freezing compartment blower fan 142 are configured to supply the air that is cooled by use of the refrigerating compartment evaporator 241 and the freezing compartment evaporator 242 provided at the duct (not shown) to the refrigerating compartment 121 and the freezing compartment 122, and to cool the air at the refrigerating compartment 121 and the freezing compartment 122, the cooled air is inlet to the duct (not shown) provided with the refrigerating compartment evaporator 241 and the freezing compartment evaporator 242.

The refrigerating compartment blower fan 141 and the freezing compartment blower fan 142 are correspondingly provided in the refrigerating compartment 121 and the freezing compartment 122, respectively, and include a refrigerating compartment blower fan 141 configured to circulate air at the duct (not shown) provided at the refrigerating compartment 121 inside the refrigerating compartment 121, and a freezing compartment blower fan 142 configured to circulate air at the duct (not shown) provided at the freezing compartment 122 inside the freezing compartment 122. In addition, as described above, the refrigerating compartment blower fan 141 is provided to perform a role to remove the frost formed at the refrigerating compartment evaporator 241.

In addition, an outside air temperature sensor (not shown) configured to sense the outside air of the refrigerator 100 may be formed at an outer wall of the body 110. The outside air temperature sensor is installed while spaced apart from a ground surface by a predetermined distance, and may be installed at an upper side of an outer wall of the refrigerator 100.

Figure 3:
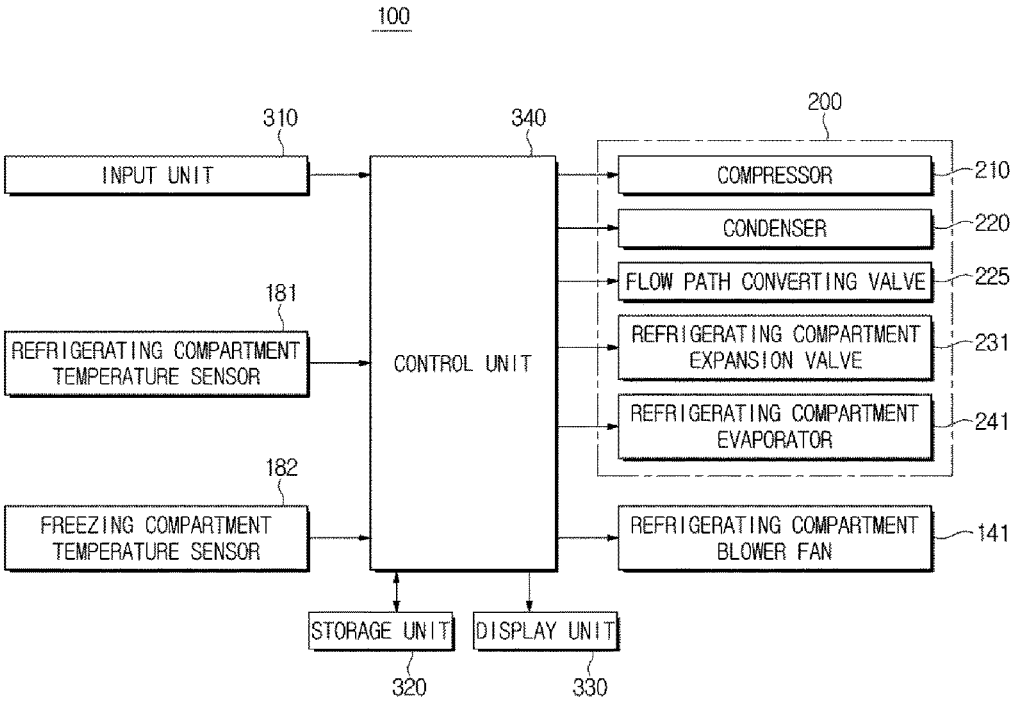
FIG. 3 is a control block diagram of the refrigerator.
Figure 4:
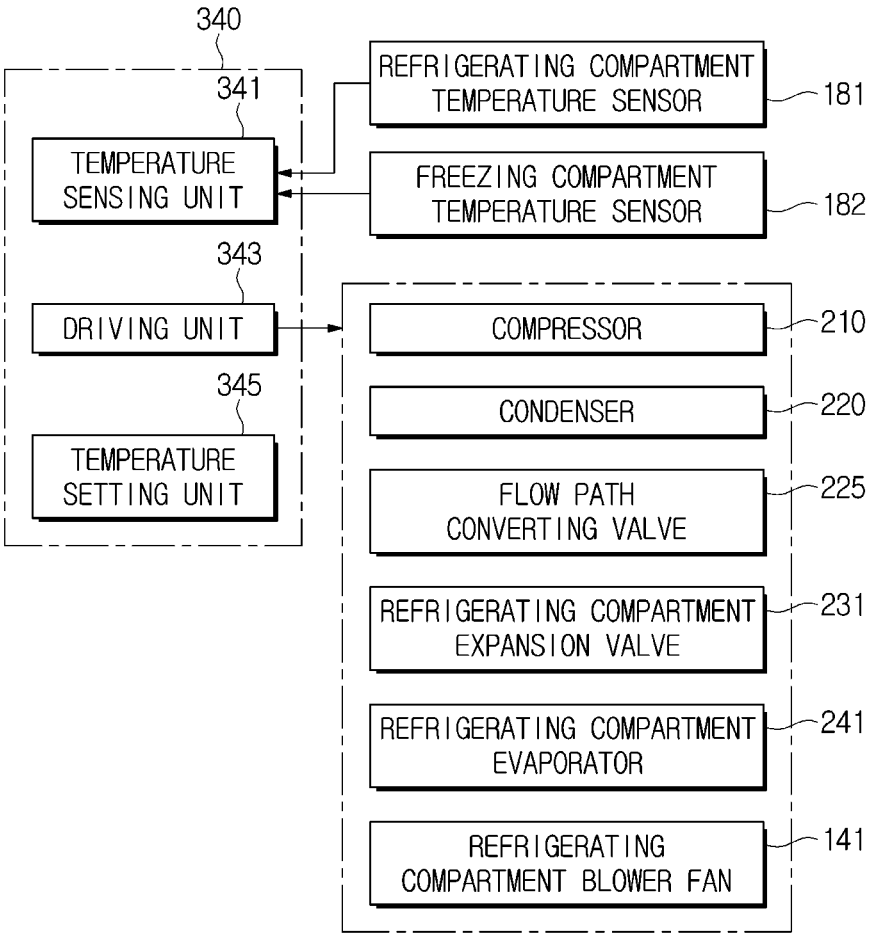
FIG. 4 is a drawing showing a detailed structure of a control unit of FIG. 3.

FIG. 3 is a control block diagram of the refrigerator, and FIG. 4 is a drawing showing a detailed structure of the control unit of FIG. 3.

Hereinafter, by referring to FIG. 7, which is a drawing provided to describe the controlling of the temperature of the refrigerator, descriptions will be provided.

As illustrated in FIG. 3, the refrigerator 100 may include an input unit 310, the refrigerating compartment temperature sensor 181, the freezing compartment temperature sensor 182, the cooling apparatus 200, the refrigerating compartment blower fan 141, a storage unit 320, the display unit 330, and the control unit, or controller, 340. The cooling apparatus 200 may include the compressor 210, the condenser 220, the flow path converting valve 225, the refrigerating compartment expansion valve 231, and the refrigerating compartment evaporator 241, and other than the above, components for the refrigerating compartment may further be included, but will be omitted for the convenience of descriptions.

In more detail, the input unit 310 may refer to a structure configured to input information through a button switch, a membrane switch, which is a switch in the shape of a plane form such as a film, or a touch-method switch, and may be provided to receive an input from a user with motion commands related to the refrigerator 100, such as whether a power is supplied to the refrigerator 100, a set temperature of the refrigerating compartment 121, and a set temperature of the freezing compartment 122, for example. The input unit 310 as such may be formed in the doors 131 and 132, but is not limited thereto.

The refrigerating compartment temperature sensor 181 is provided to sense the temperature of the refrigerating compartment 121, and the freezing compartment temperature sensor 182 is provided to sense the temperature of the freezing compartment 122, and the sensed temperature may be delivered to the control unit 340. The refrigerating compartment temperature sensor 181 and the freezing compartment temperature sensor 182 may employ a thermistor provided such that an electrical load is changed according to temperature, but is not limited thereto, and any sensor having a function capable of sensing the temperature of the refrigerating compartment 121 or the freezing compartment 122 may be used.

The cooling apparatus 200, in a state when the driving points of the refrigerating compartment 121 and the freezing compartment 122 are synchronized, is capable of stably maintaining the temperature of the refrigerating compartment 121 by performing a cooling cycle of the refrigerating compartment 121 on the basis of a cut-off temperature of the refrigerating compartment 121 that is varied according to the difference between the temperature of the refrigerating compartment 121 at the time of the driving point, which is sensed by use of the refrigerating compartment temperature sensor 181, and a cut-in temperature of the refrigerating compartment 121. The cut-in temperature of the refrigerating compartment refers to the temperature that is set such that the cooling apparatus 200 of the refrigerating compartment 121 is provided to start driving, and the cut-off temperature of the refrigerating compartment refers to the temperature that is set such that the cooling apparatus 200 of the refrigerating compartment 121 is provided to finish driving. That is, to solve the difficulty of not being able to stably maintain the average temperature of the refrigerating compartment 121 when the cooling cycle of the refrigerating compartment 121 is finished according to the predetermined cut-off temperature regardless of the temperature at the time of the driving point (the ON point of the refrigerating compartment on FIG. 7) of the refrigerating compartment 121, the refrigerator 100 is provided to variably set the cut-off temperature according to the difference between the temperature at the time of the driving point of the refrigerating compartment and the cut-in temperature.

In more detail, the cooling apparatus 200 may include the compressor 210 to compress a refrigerant at high pressure, the condenser 220 to release the heat of the compressed refrigerant, the refrigerating compartment expansion valve 231 to decompress the released refrigerant, and the refrigerating compartment evaporator 241 to absorb the heat by use of the decompressed refrigerant and deliver the heat-absorbed refrigerant to the compressor 210.

The compressor 210 described above may be driven at the cut-in temperature of the refrigerating compartment, as well as at the cut-in temperature of the freezing compartment, and to limit unneeded driving of the compressor 210, the starting point of the cooling cycle of the refrigerating compartment 121 may be synchronized to the starting point of the cooling cycle of the freezing compartment 122.

The cooling apparatus 200 described above may further include the flow path converting valve 225 configured to selectively deliver the condensed refrigerant at the condenser 220 to the refrigerating compartment expansion valve 231, and also configured to block the delivery of the refrigerant to the refrigerating compartment expansion valve 231 in a case when the inside temperature of the refrigerating compartment 121 reaches the cut-off temperature of the refrigerating compartment. The cut-off temperature of the refrigerating compartment refers to the temperature that may be varied according to the difference between the temperature at the time of the driving point of the refrigerating compartment and the cut-in temperature of the refrigerating compartment. As the varied cut-off temperature of the refrigerating compartment is reached, the flow path converting valve 225 is provided to block the delivery of the refrigerant to the refrigerating compartment expansion valve 231, and the cooling cycle of the refrigerating compartment 121 may be taken place according to the environment of the refrigerating compartment 121, separately from the cooling cycle of the freezing compartment 122, and due to the above, the average temperature of the refrigerating compartment 121 may stably be maintained.

The refrigerating compartment blower fan 141 is capable of drafting the heat-exchanged air at the refrigerating compartment evaporator 241 to the refrigerating compartment 121.

The storage unit 320 is provided to store a variety of information related to the refrigerator 100, such as the cut-in temperature of the refrigerating compartment and the cut-off temperature of the refrigerating compartment, and is capable of providing corresponding information according to the request of the control unit 340.

The display unit 330 may be employed with a Liquid Crystal Display (LCD) panel or an Organic Light Emitting Diode (OLED) panel, for example, and is capable of outputting motion information of the refrigerator 100, such as the set temperature and current temperature of the refrigerating compartment 121, the set temperature and current temperature of the freezing compartment 122, and additional various services including weather, for example. The display unit 330 may be formed in the door 131 and 132, but is not limited thereto.

The control unit 340 may be able to control the driving of the cooling apparatus 200 by varying the cut-off temperature of the refrigerating compartment according to the difference between the temperature at the time of the driving point of the refrigerating compartment and the cut-in temperature of the refrigerating compartment.

As illustrated on FIG. 4, the control unit, or controller, 340 may include a temperature sensing unit, or temperature sensor, 341 to sense the inside temperature of the refrigerating compartment 121 through the refrigerating compartment temperature sensor 181, a driving unit, or driver, 343 to control the driving of the cooling apparatus 200 according to the temperature of the freezing compartment at the time of the driving point and the cut-off temperature of the refrigerating compartment, and a temperature setting unit, or temperature setter, 345 to variably set the cut-off temperature of the refrigerating compartment as to stably maintain the temperature of the refrigerating compartment according to the difference between the temperature of the refrigerating compartment at the time of the driving point and the cut-in temperature of the refrigerating compartment.

At this time, as the driving points of the refrigerating compartment 121 and the freezing compartment 122 are synchronized and in accord to each other, the driving unit 343 is provided to drive the cooling apparatus 200 of the refrigerating compartment as well at the time of the driving point of the freezing compartment 122. That is, the driving unit 343, as the cooling apparatus 200 is provided to start driving according to the driving point of the freezing compartment 122, is provided to compensate the occurrence of the difference between the temperature at the time of the driving point of the refrigerating compartment and the cut-in temperature of the refrigerating compartment, which is predetermined, by finishing the driving of the cooling apparatus 200 of the refrigerating compartment 121 according to the varied cut-off temperature of the refrigerating compartment. As a result, the inside temperature of the refrigerating compartment 121 may be stable maintained.

In addition, the temperature setting unit 345 is capable of variably setting the cut-off temperature of the refrigerating compartment so that the temperature of the refrigerating compartment may be stably maintained according to the difference between the temperature at the time of the driving point of the refrigerating compartment and the cut-in temperature of the refrigerating compartment. The cut-off temperature of the refrigerating compartment may be variably set as much as the difference between the temperature of the refrigerating compartment at the time of the driving point and the cut-in temperature of the refrigerating compartment.

For example, the temperature setting unit 345, in a case when the temperature at the time of the driving point of the refrigerating compartment is lower than the cut-in temperature of the refrigerating compartment, may be able to adjust the cut-off temperature of the refrigerating compartment higher than the predetermined cut-off temperature of the refrigerating compartment. As illustrated on FIG. 7, the cut-in temperature of the refrigerating compartment is provided to be higher than the cut-off temperature of the refrigerating compartment.

Figure 7:
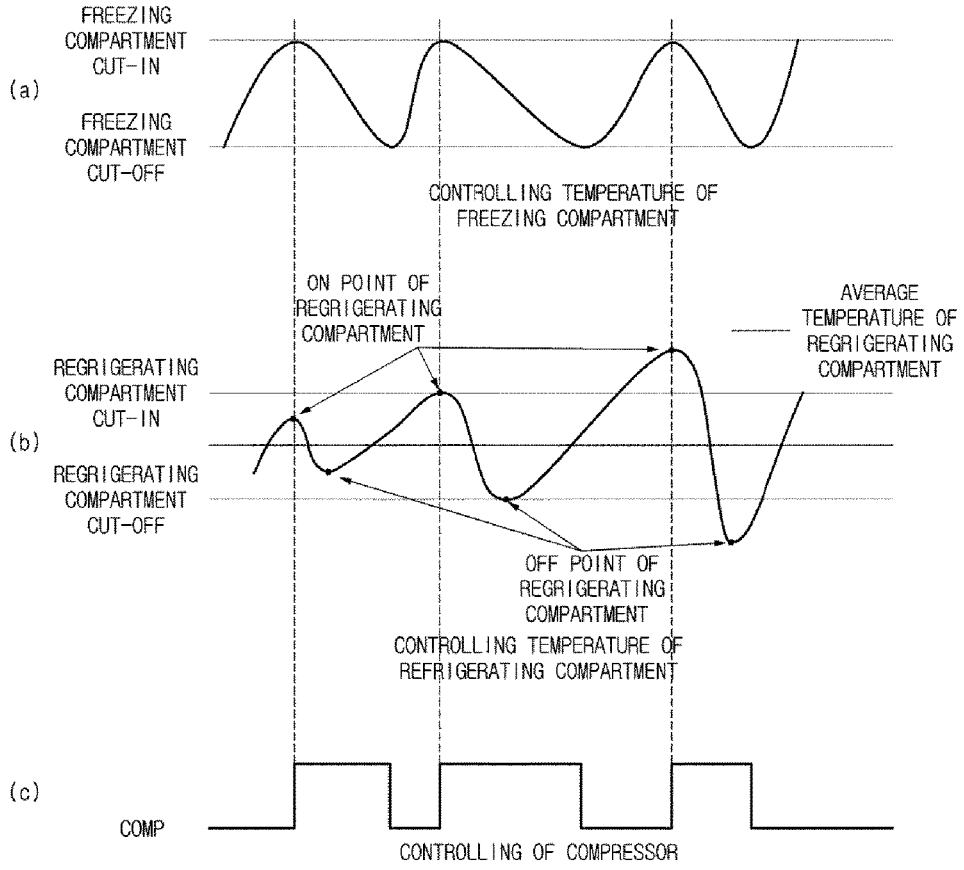
FIG. 7 is a drawing to describe a controlling of a temperature of the refrigerator.
Figure 8:
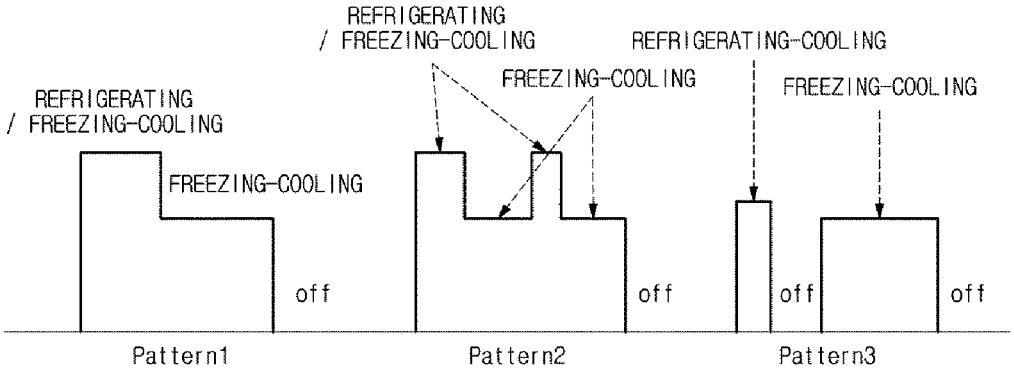
FIG. 8 is a drawing to describe driving patterns of a refrigerating compartment and a freezing compartment according to the conventional technology.
Figure 9:
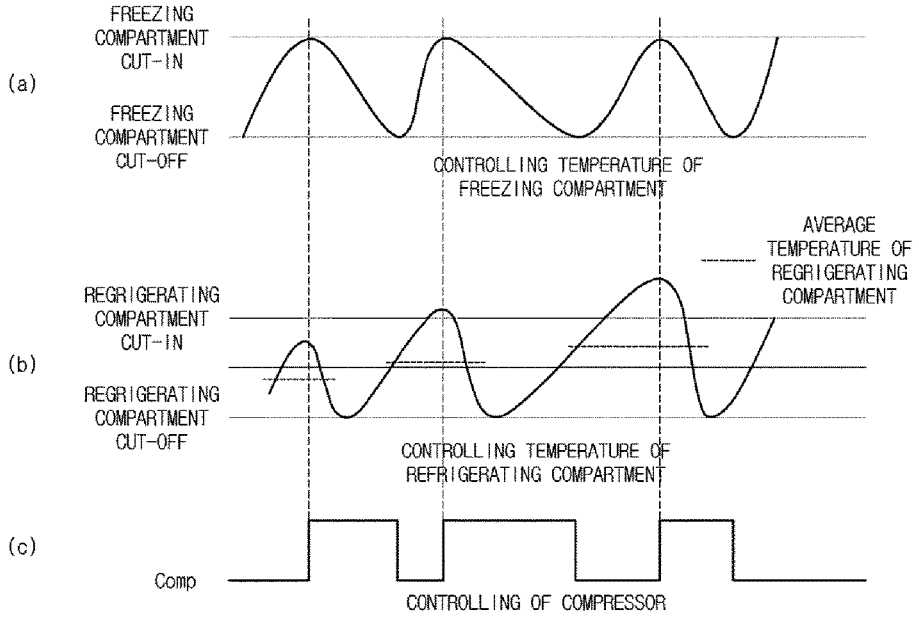
FIG. 9 is a drawing to describe a controlling of a temperature of a refrigerator according to the conventional technology.

As illustrated on FIG. 7, the temperature setting unit 345 may be able to variably adjust the cut-off temperature of the refrigerating compartment, so that the range of temperature increase of the refrigerating compartment at the time of the driving point and the range of temperature decrease of the cut-off temperature of the refrigerating compartment are equal to each other, while having the average temperature of the refrigerating compartment as a reference.

In addition, the temperature setting unit 345 is capable of adjusting the cut-off temperature of the refrigerating compartment to be lower than the predetermined cut-off temperature of the refrigerating compartment, in a case when the temperature of the refrigerating compartment at the time of the driving point is higher than the cut-in temperature of the refrigerating compartment. The temperature setting unit 345 may be able to variably adjust the cut-off temperature of the refrigerating compartment, so that the range of temperature increase of the refrigerating compartment at the time of the driving point and the range of temperature decrease of the cut-off temperature of the refrigerating compartment are equal to each other, while having the average temperature of the refrigerating compartment as a reference.

In addition, the temperature setting unit 345 may be able to maintain the cut-off temperature of the refrigerating compartment in a set state, in a case when the temperature of the refrigerating compartment at the time of the driving point is equal to the cut-in temperature of the refrigerating compartment.

Figure 5:
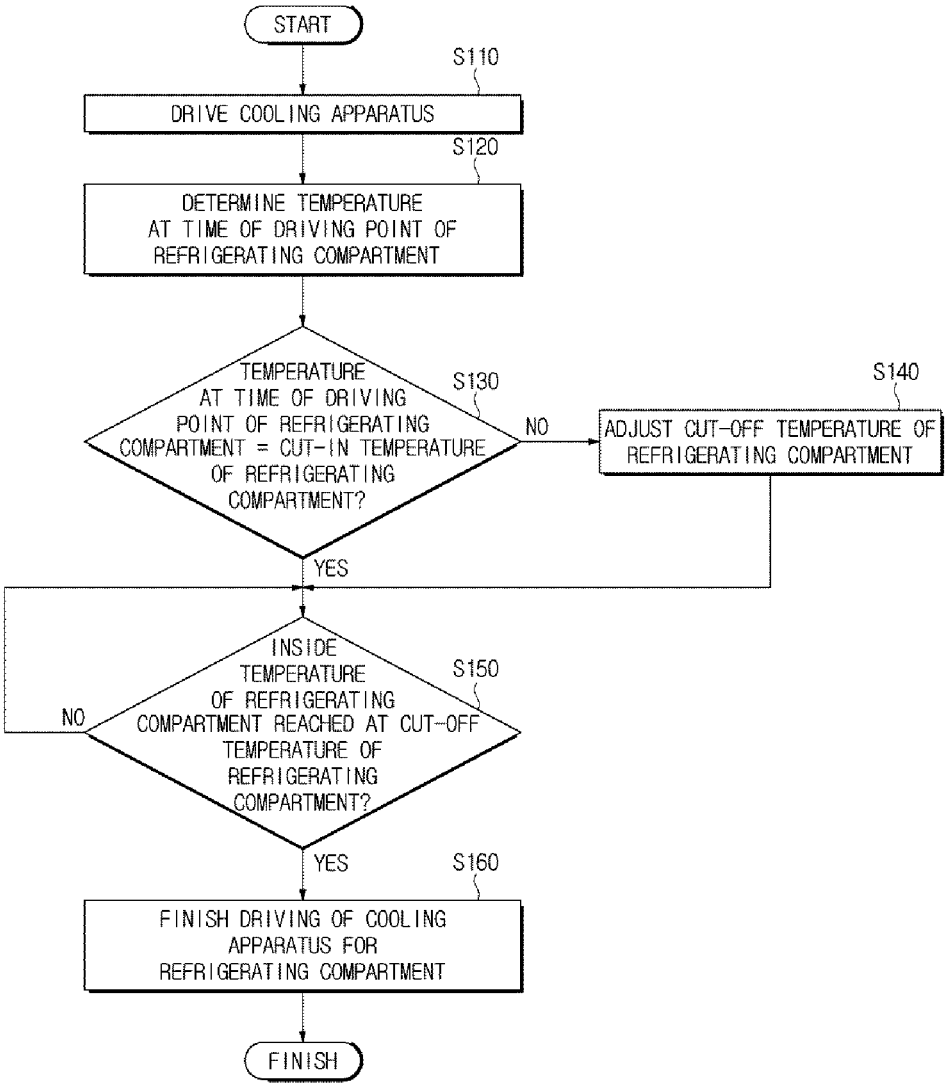
FIG. 5 is a flow chart to describe a control method of the refrigerator.

FIG. 5 is a flow chart to describe a control method of the refrigerator.

First, the refrigerator 100 drives the cooling apparatus 200 of the freezing compartment 122 and the refrigerating compartment 121 (operation S110). The driving point of the refrigerating compartment 121 is synchronized to the driving point of the freezing compartment 122, and thus as the freezing compartment 122 is driven, the refrigerating compartment 121 is driven as well.

As described above, the cooling apparatus 200 may include the compressor 210, the condenser 220, the flow path converting valve 225, the refrigerating compartment expansion valve 231, and the refrigerating compartment evaporator 241, and while the components for the freeing compartment may be included may be included other than the above, the components as such will be omitted for the purpose of convenience. The starting of the cooling cycle of the refrigerating compartment 121 refers to the starting of the driving of the cooling apparatus 200 as well as the compressor 210. The compressor 210 may be driven when reached at the cut-in temperature of the freezing compartment 122, not only when reached at the cut-in temperature of the refrigerating compartment 121. However, the starting of the driving of the cooling cycle of the refrigerating compartment 121 may be synchronized to the starting of the driving of the cooling cycle of the freezing compartment 122 as to limit unneeded driving of the compressor 210.

Next, the refrigerator 100 may be able to sense the temperature at the time of driving point of the refrigerating compartment 121 (operation S120).

Next, the refrigerator 100 may be able to confirm if the temperature at the time of the driving point of the refrigerating compartment 121 is equal to the cut-in temperature of the refrigerating compartment (operation S130). For example, as illustrated on (b) of FIG. 7, the temperature at the time of the driving point ("ON" point of the refrigerating compartment) of the refrigerating compartment 121 is confirmed if such is equal to the cut-in temperature of the refrigerating compartment.

After the confirmation is made and in a case when the temperature at the time of the driving point of the refrigerating compartment is not equal to the cut-in temperature of the refrigerating compartment, the refrigerator 100 may be able to variably adjust the cut-off temperature of the refrigerating compartment according to the difference between the temperature at the time of the driving point of the refrigerating compartment and the cut-in temperature of the refrigerating compartment (operation S140).

The refrigerator 100 may be able to variably set the cut-off temperature of the refrigerating compartment as much as the difference between the temperature at the time of the driving point of the refrigerating compartment and the cut-in temperature of the refrigerating compartment. As illustrated on FIG. 7, the refrigerator 100 may be able to variably adjust the cut-off temperature of the refrigerating compartment, so that the range of temperature increase of the refrigerating compartment at the time of the driving point and the range of temperature decrease of the cut-off temperature of the refrigerating compartment are equal to each other, while having the average temperature of the refrigerating compartment as a reference.

In a case when the inside temperature of the refrigerating compartment reaches the cut-off temperature of the refrigerating compartment, the refrigerator 100 may be able to finish the driving of the cooling apparatus 200 of the refrigerating compartment (operation S150 and operation S160). The cooling apparatus 200, while the refrigerant condensed at the condenser 220 is selectively delivered to the expansion valve for a refrigerating compartment 231, may include the flow path converting valve 225 to block the refrigerant from being delivered to the expansion valve for a refrigerating compartment 231, in a case when the inside temperature of the refrigerating compartment reaches the cut-off temperature of the refrigerating compartment 121, and by blocking the delivery of the refrigerant through the such, the driving of the cooling cycle of the refrigerating compartment 121 is finished. The cut-off temperature of the refrigerating compartment variably adjusted at operation S140 refers to as the varied temperature according to the difference between the temperature at the time of the driving point of the refrigerating compartment and the cut-in temperature of the refrigerating compartment. As the inside temperature of the refrigerating compartment 121 reaches the varied cut-off temperature of the refrigerating compartment, the driving of the cooling cycle of the refrigerating compartment 121 is performed separately from the driving of the cooling cycle of the freezing compartment 122, by the delivery of the refrigerant to the refrigerating compartment expansion valve 231 blocked by use of the flow path converting valve 225, and thus the average temperature of the refrigerating compartment 121 may be stably maintained.

After the confirmation is made at operation S130 and in a case when the temperature at the time of the driving point of the refrigerating compartment is equal to the cut-in temperature of the refrigerating compartment, the refrigerator 100 may be able to maintain the cut-off temperature of the refrigerating compartment at the presently set state without changes being made.

Figure 6:
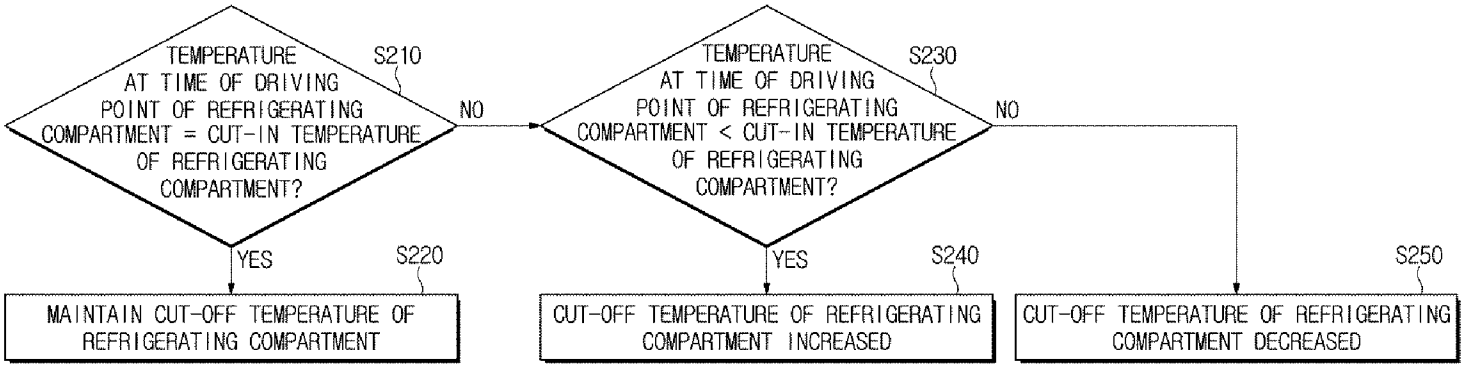
FIG. 6 is a flow chart to describe a method of varying a cut-off temperature of the refrigerator.

FIG. 6 is a flow chart to describe a method of varying the cut-off temperature of the refrigerator, and operation S130 and operation S140 of FIG. 5 will be described in more detail.

After the confirmation is made at operation S130 and in a case when the temperature at the time of the driving point of the refrigerating compartment is equal to the cut-in temperature of the refrigerating compartment (operation S210), the refrigerator 100 may be able to maintain the cut-off temperature of the refrigerating compartment at the set state (operation S220).

In addition, in the variably adjusting of the cut-off temperature of the refrigerating compartment of operation S140 according to the difference between the temperature at the time of the driving point of the refrigerating compartment and the cut-in temperature of the refrigerating compartment, the refrigerator 100, in a case when the temperature at the time of the driving point of the refrigerating compartment is lower than the cut-in temperature of the refrigerating compartment (operation S230), may be able to adjust the cut-off temperature of the refrigerating compartment to be higher than the predetermined cut-off temperature of the refrigerating compartment (operation S240). The cut-in temperature of the refrigerating compartment is provided to be higher than the cut-off temperature of the refrigerating compartment.

In addition, in the variably adjusting of the cut-off temperature of the refrigerating compartment of operation S140 according to the difference between the temperature at the time of the driving point of the refrigerating compartment and the cut-in temperature of the refrigerating compartment, the refrigerator 100, in a case when the temperature at the time of the driving point of the refrigerating compartment is higher than the cut-in temperature of the refrigerating compartment (operation S230), may be able to adjust the cut-off temperature of the refrigerating compartment to be lower than the predetermined cut-off temperature of the refrigerating compartment (operation S250). The cut-in temperature of the refrigerating compartment is provided to be higher than the cut-off temperature of the refrigerating compartment.

When variably adjusting the cut-off temperature of the refrigerating compartment in operation S240 and operation S250, as illustrated on FIG. 7, the refrigerator 100 may be able to variably adjust the cut-off temperature of the refrigerating compartment, so that the range of temperature increase of the refrigerating compartment at the time of the driving point and the range of temperature decrease of the cut-off temperature of the refrigerating compartment are equal to each other, while having the average temperature of the refrigerating compartment as a reference.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a refrigerating compartment;

a freezing compartment;

a refrigerating compartment temperature sensor to sense a temperature of the refrigerating compartment;

a cooling apparatus, in a state when starting time points of the refrigerating compartment and the freezing compartment are synchronized, to maintain an inside temperature of the refrigerating compartment by performing a cooling operation of the refrigerating compartment; and a controller to control the cooling apparatus by varying a cut-off temperature of the cooling apparatus according to a difference between the sensed temperature of the refrigerating compartment at a starting time point of the refrigerating compartment and a cut-in temperature of the refrigerating compartment.

2. The refrigerator of claim 1, wherein:

the cooling apparatus comprises a compressor to compress refrigerant at a high pressure;

a condenser to release heat of the compressed refrigerant;

an expansion valve for the refrigerating compartment to decompress the condensed refrigerant; and an evaporator for the refrigerating compartment to absorb heat by use of the refrigerant and deliver the evaporated refrigerant to the compressor.

3. The refrigerator of claim 2, wherein:

the cooling apparatus further comprises a flow path converting valve to selectively deliver the condensed refrigerant at the condenser to the expansion valve for the refrigerating compartment such that the refrigerant delivered to the expansion valve for the refrigerating compartment is blocked in a case when the inside temperature of the refrigerating compartment reaches the cut-off temperature of the refrigerating compartment.

4. The refrigerator of claim 2, further comprising:

a refrigerating compartment blower fan to blow the heat-exchanged air at the evaporator for the refrigerating compartment to the refrigerating compartment.

5. The refrigerator of claim 1, wherein:

the controller comprises a temperature sensor to sense an inside temperature of the refrigerating compartment from the refrigerating compartment temperature sensor;

a driver to control the driving of the cooling apparatus according to the temperature of the refrigerating compartment at the starting time point and the cut-off temperature of the refrigerating compartment; and a temperature setter to variably set the cut-off temperature of the refrigerating compartment to stably maintain the temperature of the refrigerating compartment according to the difference between the temperature of the refrigerating compartment at the starting time point of the refrigerating compartment and the cut-in temperature of the refrigerating compartment.

6. The refrigerator of claim 5, wherein:

the temperature setter variably sets the cut-off temperature of the refrigerating compartment as much as the difference between the temperature of the refrigerating compartment at the starting time point of the refrigerating compartment and the cut-in temperature of the refrigerating compartment.

7. The refrigerator of claim 6, wherein:

the temperature setter variably adjusts the cut-off temperature of the refrigerating compartment so that a temperature increase of the refrigerating compartment at the starting time point of the refrigerating compartment and a temperature decrease of the cut-off temperature of the refrigerating compartment are equal to each other while having an average temperature of the refrigerating compartment as a reference.

8. The refrigerator of claim 5, wherein:

the temperature setter maintains the cut-off temperature of the refrigerating compartment in a set state, in a case when the temperature of the refrigerating compartment at the starting time point is equal to the cut-in temperature of the refrigerating compartment.

9. A controlling method of a refrigerator, comprising:

driving, by the refrigerator, a cooling apparatus of a refrigerating compartment and a freezing compartment;

sensing a temperature of the refrigerating compartment at a starting time point of the refrigerating compartment;

determining if the temperature at the starting time point of the refrigerating compartment is equal to a cut-in temperature of the refrigerating compartment;

variably adjusting a cut-off temperature of the refrigerating compartment according to a difference between a temperature of the refrigerating compartment at a starting time point of the refrigerating compartment and a cut-in temperature of the refrigerating compartment, in a case when the temperature of the refrigerating compartment at the starting time point of the refrigerating compartment is not equal to the cut-in temperature of the refrigerating compartment; and finishing a driving of the cooling apparatus of the refrigerating compartment, in a case when an inside temperature of the refrigerating compartment reaches the cut-off temperature of the refrigerating compartment.

10. The controlling method of the refrigerator of claim 9, wherein in the variably adjusting of the cut-off temperature of the refrigerating compartment according to the difference between the temperature of the refrigerating compartment at the starting time point and the cut-in temperature of the refrigerating compartment, the cut-off temperature is variably set as much as the difference between the temperature of the refrigerating compartment at the starting time point of the refrigerating compartment and the cut-in temperature of the refrigerating compartment.

11. The controlling method of the refrigerator of claim 10, wherein:

the cut-off temperature of the refrigerating compartment is variably adjusted so that a temperature increase of the refrigerating compartment at the starting time point and a temperature decrease of the cut-off temperature of the refrigerating compartment are equal to each other while having an average temperature of the refrigerating compartment as a reference.

12. The controlling method of the refrigerator of claim 9, wherein:

in a case when the temperature of the refrigerating compartment at the starting time point of the refrigerating compartment is equal to the cut-in temperature of the refrigerating compartment, the cut-off temperature of the refrigerating compartment is maintained at a set state.

13. A method comprising:

initiating a cooling operation of a first food storage compartment and a second food storage compartment based on a temperature of the first food storage compartment;

measuring a temperature of the second food storage compartment when the cooling operation is initiated;

adjusting, by a controller, a cut-off temperature of the cooling operation based on a difference between the measured temperature of the second food storage compartment when the cooling operation is initiated and a predetermined cut-in temperature of the second food storage compartment; and ending the cooling operation when the temperature of the second food storage compartment reaches the cut-off temperature.

14. The method of claim 13, wherein the adjusting the cut-off temperature comprises calculating the difference between the measured temperature of the second food storage compartment when the cooling operation is initiated and the predetermined cut-in temperature of the second food storage compartment; and adding the calculated difference to the cut-off temperature.

* * * * *